US008631553B2

(12) United States Patent
Gleim

(10) Patent No.: US 8,631,553 B2
(45) Date of Patent: Jan. 21, 2014

(54) TUBE SPLICING MACHINE

(75) Inventor: Robert A. Gleim, Bellenfonte, PA (US)

(73) Assignee: Polyflow, Inc., Oaks, PA (US)

( * ) Notice: Subject to any disclaimer, the term of this patent is extended or adjusted under 35 U.S.C. 154(b) by 472 days.

(21) Appl. No.: 12/956,231

(22) Filed: Nov. 30, 2010

(65) Prior Publication Data

US 2011/0132059 A1 Jun. 9, 2011

Related U.S. Application Data

(60) Provisional application No. 61/265,962, filed on Dec. 2, 2009.

(51) Int. Cl.
*B21D 39/00* (2006.01)
*B23P 11/00* (2006.01)

(52) U.S. Cl.
USPC ..... 29/508; 29/521; 29/283.5; 72/417

(58) Field of Classification Search
USPC ..... 29/505, 508, 518, 521, 283.5; 72/376, 72/416; 156/122; 425/392, 394, 436 R
See application file for complete search history.

(56) References Cited

U.S. PATENT DOCUMENTS

| | | | | | |
|---|---|---|---|---|---|
| 2,272,881 | A * | 2/1942 | Stevens | 156/366 |
| 3,848,451 | A * | 11/1974 | Allin | 72/402 |
| 4,057,882 | A * | 11/1977 | Bowmer | 29/283.5 |
| 4,418,458 | A * | 12/1983 | Hunter | 29/237 |
| 5,027,489 | A * | 7/1991 | Johnston | 29/237 |
| 5,305,510 | A * | 4/1994 | Croft et al. | 29/237 |
| 7,143,626 | B2 * | 12/2006 | Dole | 72/416 |
| 7,506,580 | B2 * | 3/2009 | Bronnimann | 100/269.01 |
| 7,984,538 | B2 * | 7/2011 | McKay | 29/237 |

* cited by examiner

*Primary Examiner* — Alexander P Taousakis
(74) *Attorney, Agent, or Firm* — Volpe and Koenig, P.C.

(57) ABSTRACT

A tube splicing machine is provided which includes a frame on which a die holder is located. A swaging die is removably mounted in the die holder, and the die holder includes a main plate and a top plate that is removably connected to the main plate. A die holding opening is defined through a portion of the main plate and the top plate in which the swaging die is inserted. The swaging die includes two die parts that together define a die opening and are separable along a mid-line of the die opening. A splice fitting engagement plate with a splice fitting engagement portion is located on the frame, with the splice fitting engagement plate having an opening or an openable top to allow removable connection to a splice fitting. An actuator is connected between the splice fitting engagement plate and the die holder for moving the splice fitting engagement plate relative to the die holder from an initial position to a swaged position, in order to swage the splice fitting onto a length of hose or tubing. This allows a splice fitting to join quasi-endless lengths of hose or tubing in a simple manner.

11 Claims, 10 Drawing Sheets

12
24
26
25
29
22
27
23
60B
60C
62B
66
64
53
40
50
14
17
56
28
85
87
80
82
86
84

TUBE SPLICING MACHINE

CROSS-REFERENCE TO RELATED APPLICATIONS

This application claims the benefit of U.S. Provisional Application No. 61/265,962, filed Dec. 2, 2009, which is incorporated herein by reference as if fully set forth.

BACKGROUND

The present invention relates to a tubing splicing machine, and more particularly, a splicing machine for splicing quasi-endless lengths of tubing or hose used in underground petroleum recovery and gathering operations.

Underground tubing used in petroleum recovery and gathering requires tubing lengths that extend 5000 feet or more. These lengths can be lowered vertically into underground petroleum deposits through well heads or laid horizontally to transport oil and gas from a well to a processing facility. An environmental requirement for the industry is that such lengths of tubing or hose cannot have mechanical couplings which can become undone. Currently, the tubing or hose used in many such applications is made from a multi-layer polymeric material and when a splice is required, individual coupling members are permanently swaged onto the ends of the quasi-endless lengths of tubing to be joined. These swaged-on couplings are then welded together so that a permanent splice is created.

Such splices cannot be entirely avoided by forming the hose or tubing in one piece because the coils of the hose or tubing used are limited to a certain length for transport, for example, 1000 to 2500 feet depending upon the specific hose or tubing. However, given these great lengths, these hoses or tubes are considered to be quasi-endless.

In the known field splicing operation, a simple swaging device can be used which attaches a coupling to an end of the tubing. Such couplings generally have an insertion portion that extends into the end of the tube and a collar which extends over the outside of the tube. The known equipment can either expand the insert outwardly or crimp the collar inwardly, trapping the hose or tubing material between the collar and the insert. However, this known swaging equipment requires open access to the tubing end for removal of the installation equipment once the coupling is swaged in place.

It would be desirable to provide a more efficient means for splicing quasi-endless lengths of tubing or hose which avoids the need for welding and can be easily carried out in the field in a simple and efficient manner.

SUMMARY

A tube splicing machine is provided which includes a frame to which a die holder is connected. A swaging die is removably mounted in the die holder, and the die holder includes a main plate and a top plate that is removably connected to the main plate. A die holding opening is defined through a portion of the main plate and the top plate in which the swaging die is inserted. The swaging die includes two die parts that together define a die opening and are separable along a mid-line of the die opening. A splice fitting engagement plate with a splice fitting engagement portion is also located on the frame. The splice fitting engagement plate has an opening or an openable top to allow removable connection to a splice fitting. An actuator is connected to the frame and to the splice fitting engagement plate or the die holder for moving the splice fitting engagement plate relative to the die holder from an initial position to a swaged position, in order to swage the splice fitting onto a length of hose or tubing.

According to the invention, the splice fitting engagement plate or the die holder with the swaging die can be connected to the frame, and the other of the die holder with the swaging die or the splice fitting engagement plate is driven by the actuator in order to swage the splice fitting onto a length of hose or tubing.

According to the first embodiment of the invention, first and second lengths of tubing to be spliced and a splice fitting having first and second insertion portions facing in opposite directions as well as first and second swaging collars are provided. An end of the first length of tubing is located in the swaging die and the first swaging collar is positioned on the end of the first length of tubing along with the first insertion portion of the splice fitting being inserted into the first tubing end. The splice fitting engagement portion on the splice fitting engagement plate is engaged with the splice fitting and the actuator is actuated so that the splice fitting engagement plate pushes the splice fitting against the first swaging collar into the swaging die, compressing the swaging collar against the first length of tubing and the tubing against the first insertion portion to form a permanent connection. Then the die holder and swaging die are opened and the first length of tubing with the attached splice fitting is removed, the tube splicing machine is then relocated to an opposite side of the splice fitting and the second length of tubing is located in the swaging die. The second swaging collar is located on the end of the second length of tubing and a second insertion portion of the splice fitting is inserted through the second swaging collar and into the end of the second length of tubing to be spliced. The splice fitting is then engaged by the splice fitting engagement portion on the splice fitting engagement plate. The actuator is actuated so that the splice fitting engagement plate pushes the splice fitting and the second swaging collar into the swaging die, compressing the second swaging collar against the end of the second length of tubing and the second length of tubing against the second insertion portion of the splice fitting to form a permanent connection. The die holder and the second swaging die are then opened and the second length of tubing is removed with the attached splice fitting so that a permanent connection is made between the first and second lengths of tubing.

In the second embodiment, the splice fitting engagement plate is held stationary and to the actuator is used to move the swaging die over the swaging collar of the spice fitting in order to compress the swaging collar against the tubing.

The arrangements according to the invention allow for the joining of lengths of hose or tubing, including quasi-endless lengths, without the need for welding, threading, or bolting, and produce a reliable and inexpensive splice.

Other aspects of the invention are defined below and in the claims and have not been repeated here for the sake of brevity. Those skilled in the art will recognize that one or more of the features can be used alone or in combination in order to provide a tube splicing machine that is simple to assemble and use, and results in lower cost.

BRIEF DESCRIPTION OF THE DRAWINGS

The foregoing summary and the following detailed description will be better understood when read in conjunction with the appended drawings, which illustrate preferred embodiments of the invention. In the drawings.

DETAILED DESCRIPTION OF THE PREFERRED EMBODIMENTS

Figure 1:
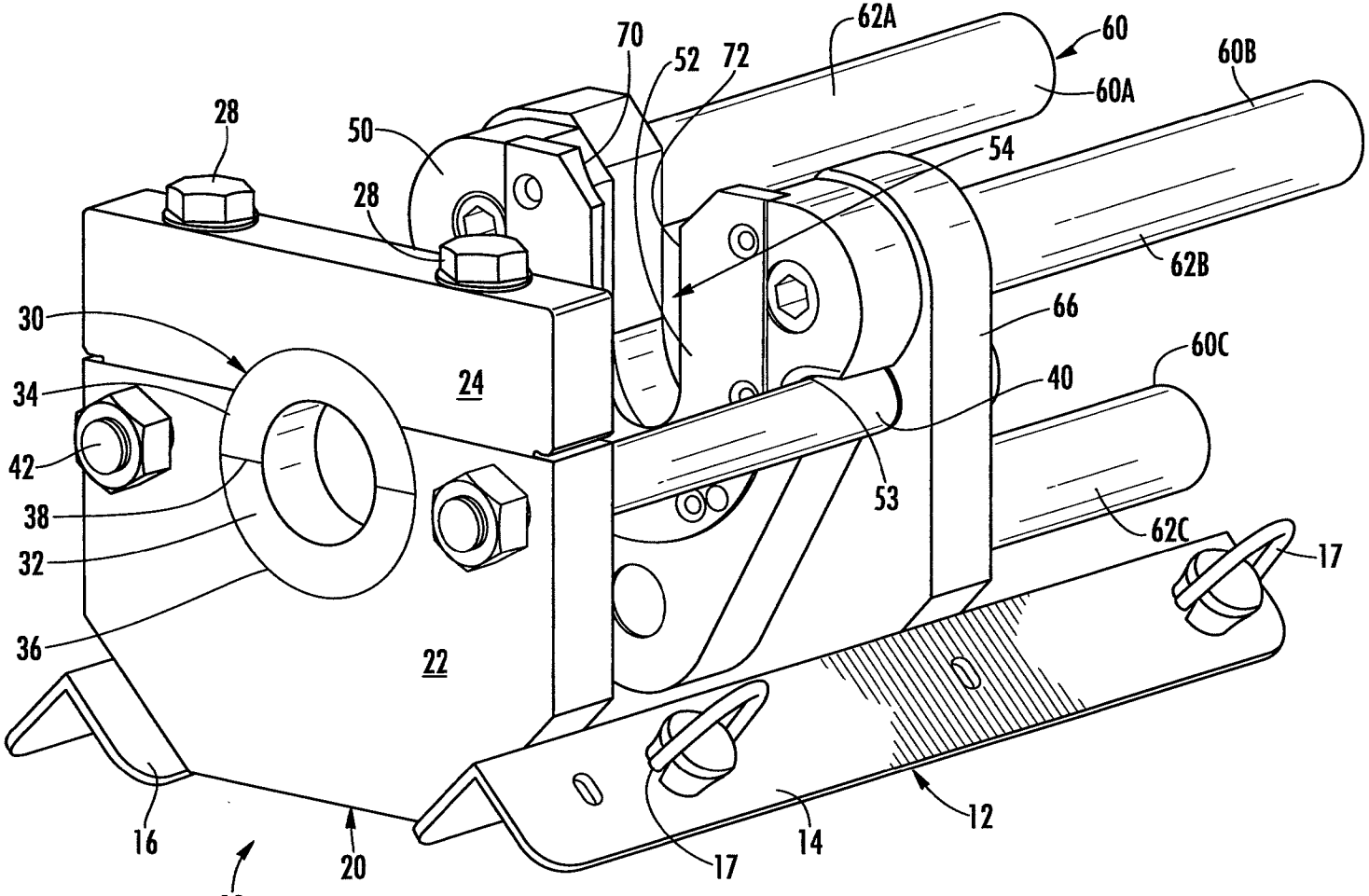
FIG. 1 is a perspective view of a tube splicing machine in accordance with the present invention.
Figure 2:
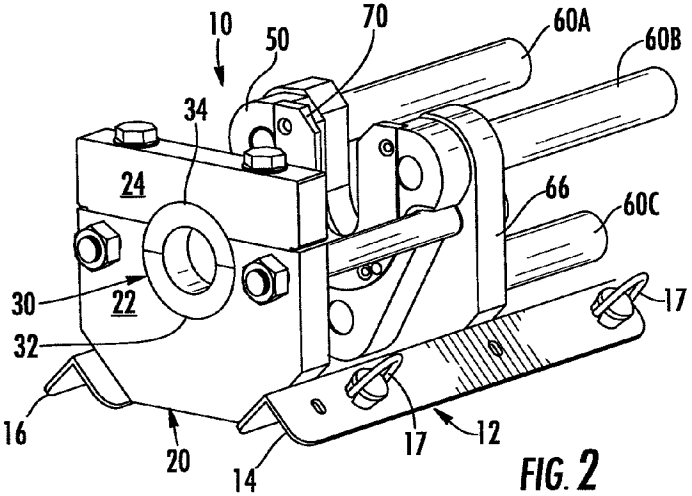
FIG. 2 is a view similar to FIG. 1 of the tube splicing machine according to the invention.
Figure 5:
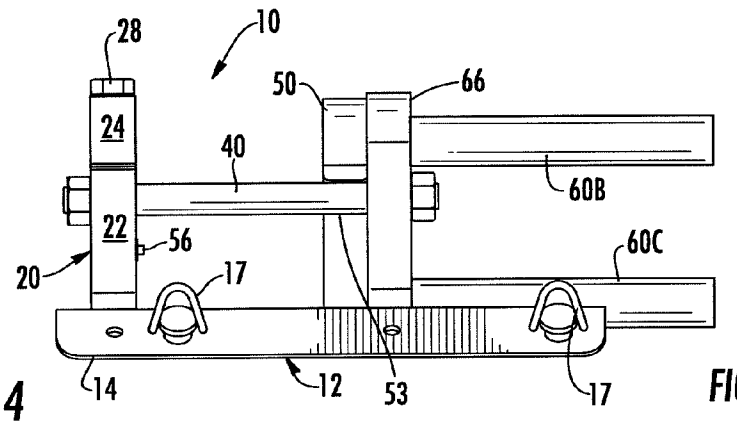
FIG. 5 is a side elevational view of the tube splicing machine of FIG. 1.
Figure 3:
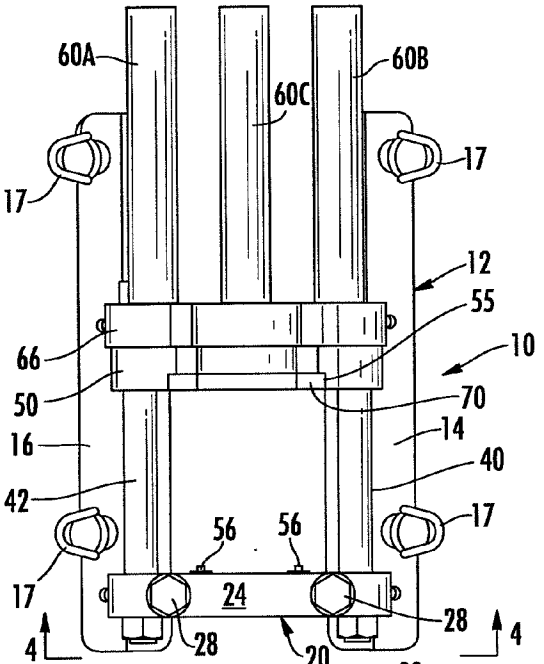
FIG. 3 is a top view of the tube splicing machine of FIGS. 1 and 2.
Figure 4:
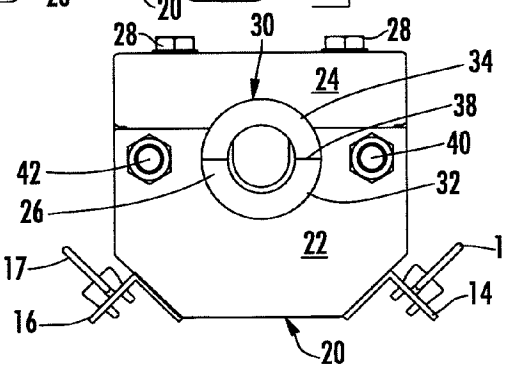
FIG. 4 is a front view taken along lines 4-4 in FIG. 3.
Figure 6:
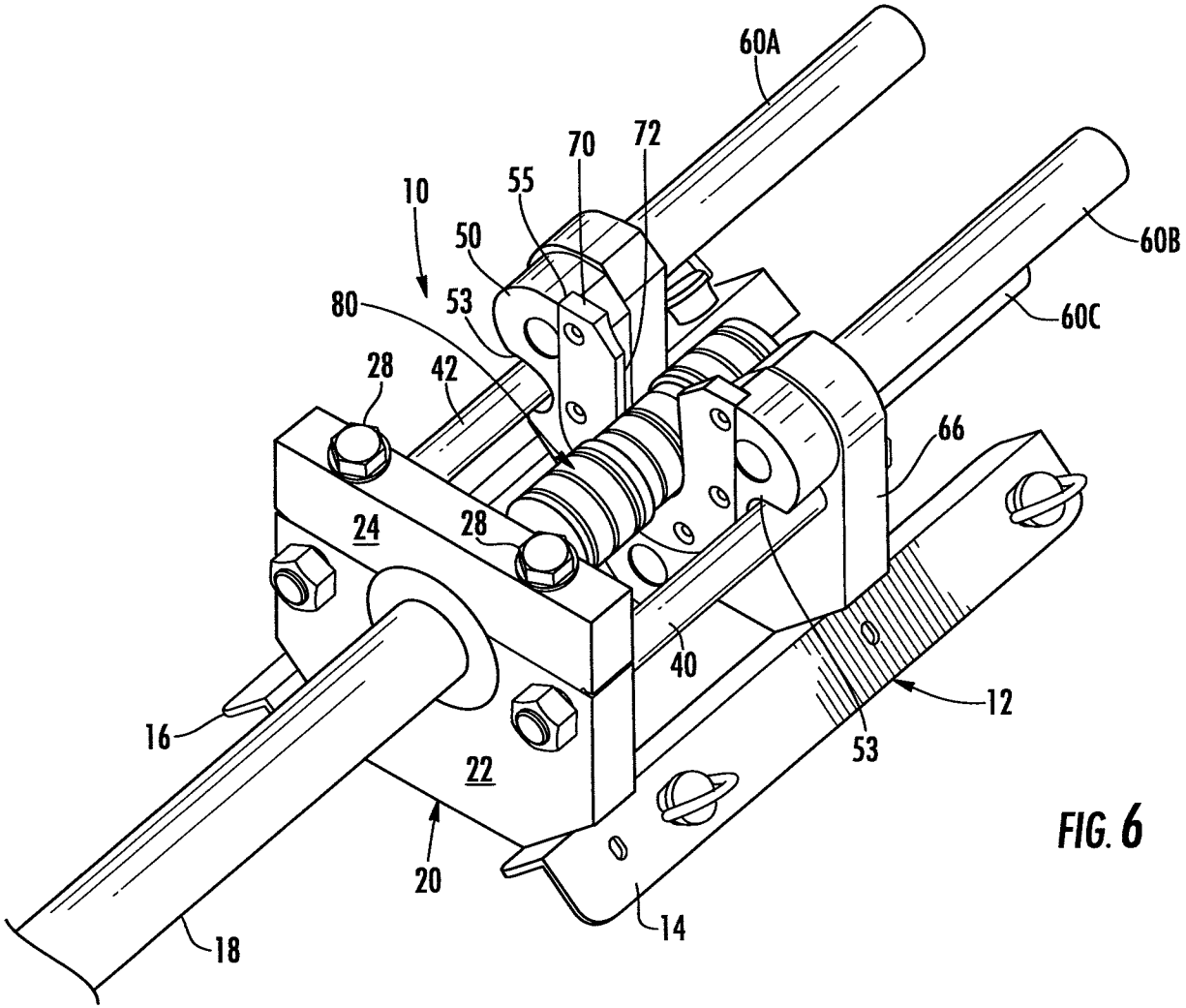
FIG. 6 is a perspective view similar to FIG. 1 showing the tube splicing machine installing a splice fitting on two quasi-endless lengths of tubing or hose.

Certain terminology is used in the following description for convenience only and is limiting. The words "front," "rear," "upper" and "lower" designate directions in the drawings to which reference is made. The words "inwardly" and "outwardly" refer to the directions toward and away from the parts referenced in the drawings. A reference to a list of items that are cited as "at least one of a, b or c" (where a, b or c represent the items being listed) means any single one of the items a, b or c, or combinations thereof. The terms "pipe", "tubing" and "hose" are used interchangeably herein. The terminology includes the word specifically noted above, derivatives thereof and words of similar import.

Referring to FIGS. 1-5, a first preferred embodiment of the tube splicing machine 10 is shown. The tube splicing machine 10 includes a frame 12, preferably formed by runners 14 and 16. The runners 14 and 16 are preferably bent-up or extruded angles and may be made from aluminum, steel or any other suitable material. Lift lugs 17 may be attached to the runners 14, 16 for ease in moving the tube splicing machine 10.

A die holder 20 is connected to the frame 12, and more particularly to the runners 14, 16. The die holder 20 includes a main plate 22 and a top plate 24 that is removably connected to the main plate 22. The connection to the runners 14 and 16 can be made by threaded fasteners, welding or any other suitable connection, depending upon the materials used. A die holding opening 26 is defined through a portion of the main plate 22 and the top plate 24. In the preferred embodiment, the majority of the opening is located in the main plate 22, and the width of the opening at the top of the main plate 22 is at least as big as the outside diameter of the hose or tubing being joined. As shown in FIGS. 11-14, the opening 26 in the main plate 22 and top plate 24 is preferably tapered. The top plate 24 is connected to the main plate via bolts or screws 28 which are inserted through openings 29 in the top plate 24 and extend into threaded holes 27 in the main plate 22. Preferably, alignment pins 23 are located in the main plate 22 at the interface between the main plate 22 and the top plate 24, and complementarily located openings are provided in the top plate 24 at the interface. In the preferred embodiment, the main plate 22 and top plate 24 are both made from tool steel; however, other suitable materials could be utilized.

Figure 16:
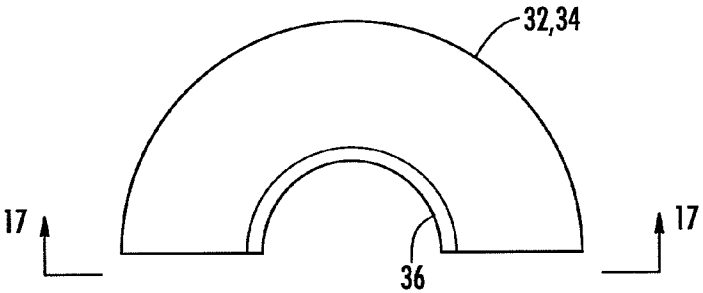
FIG. 16 is a front view of a swaging die.
Figure 17:
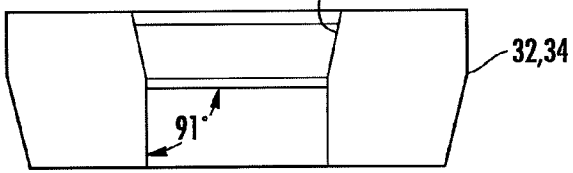
FIG. 17 is view of line 17-17 in FIG. 16.
Figure 18:
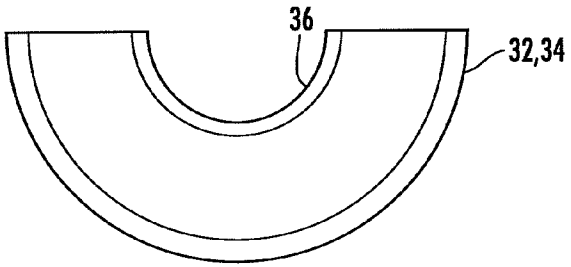
FIG. 18 is a rear view of the swaging die.

The swaging die 30 is located in the die holding opening 26 that is defined through the main plate 22 and the top plate 24. The swaging die 30 includes two die parts 32, 34 that together define a die opening 36. As shown in detail in FIGS. 16-18, preferably the die parts 32, 34 are formed as identical halves. The die parts 32, 34 are separable along a mid-line 38 of the die opening 36. The mating surfaces of the die parts 32, 34 may fit flush against one another or may inter-engage with one another, for example, through alignment projections or pins of one die part engaging in complementary recesses or openings in the mating surface of the other die part. Preferably, the die parts 32, 34 are made from hardened steel, such as 4340 steel with a Rockwell hardness >45C.

Figure 7:
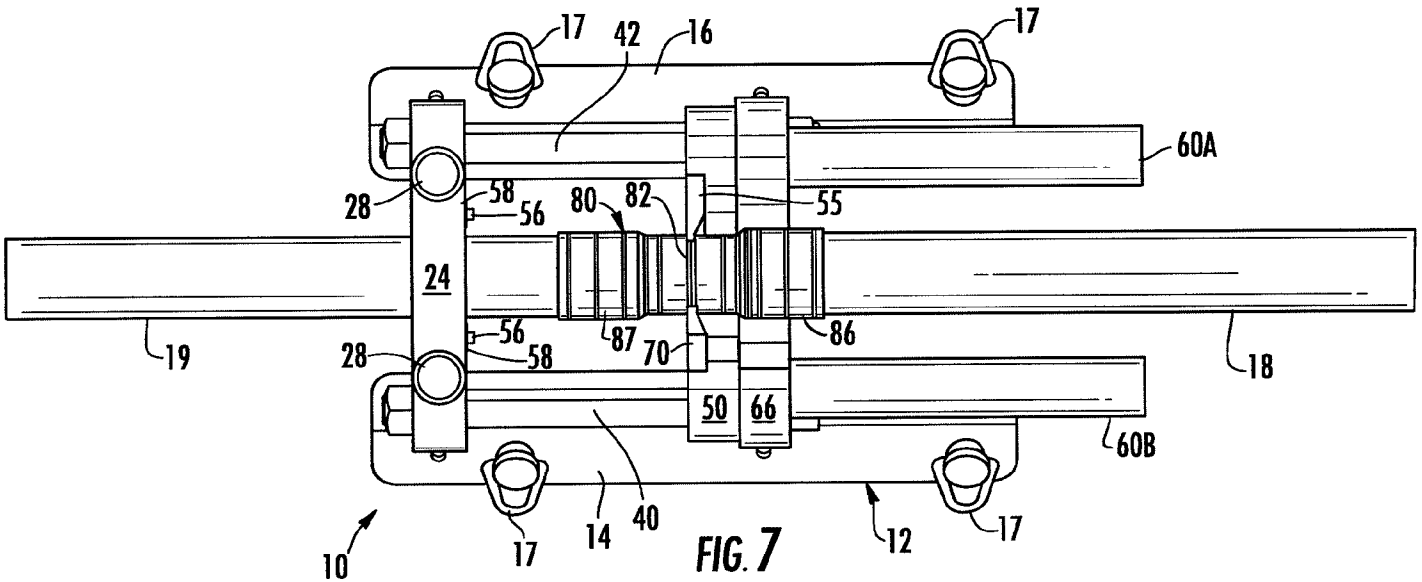
FIG. 7 is a top view of the tube splicing machine in use shown in FIG. 6.
Figure 8:
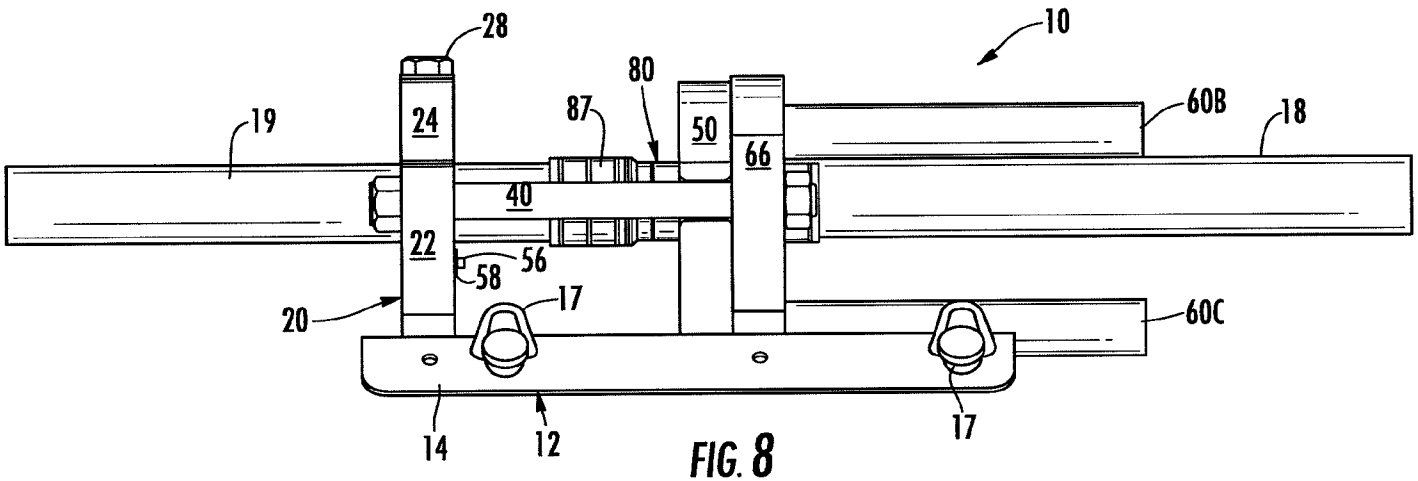
FIG. 8 is a side elevational view of the tube splicing machine in use as shown in FIG. 6.
Figure 9:
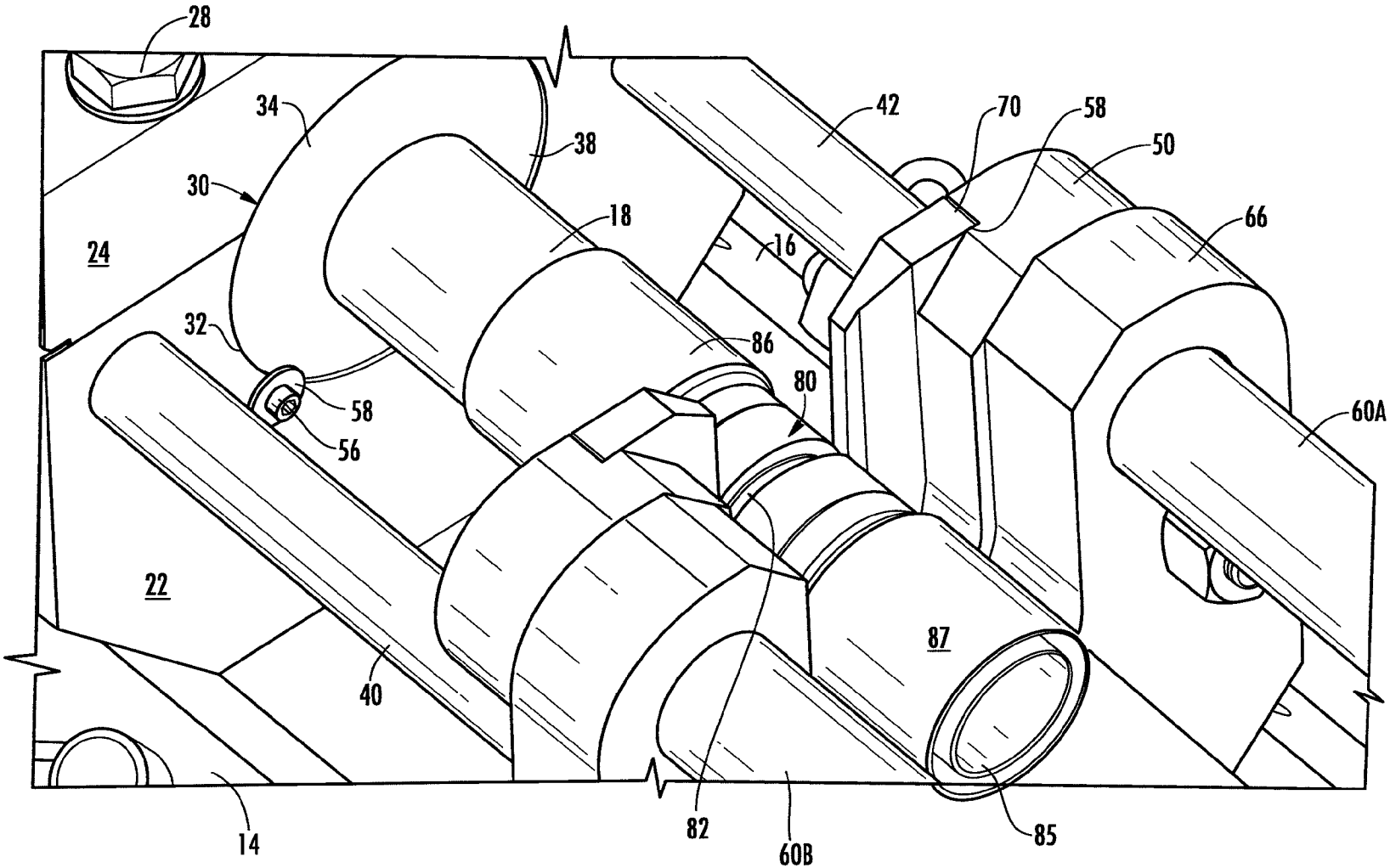
FIG. 9 is an enlarged perspective view of the tube splicing machine shown in FIG. 6 showing the engagement of the splice fitting engagement plate with the splice fitting.
Figures 10, 11, 12, 13, 14, 15:
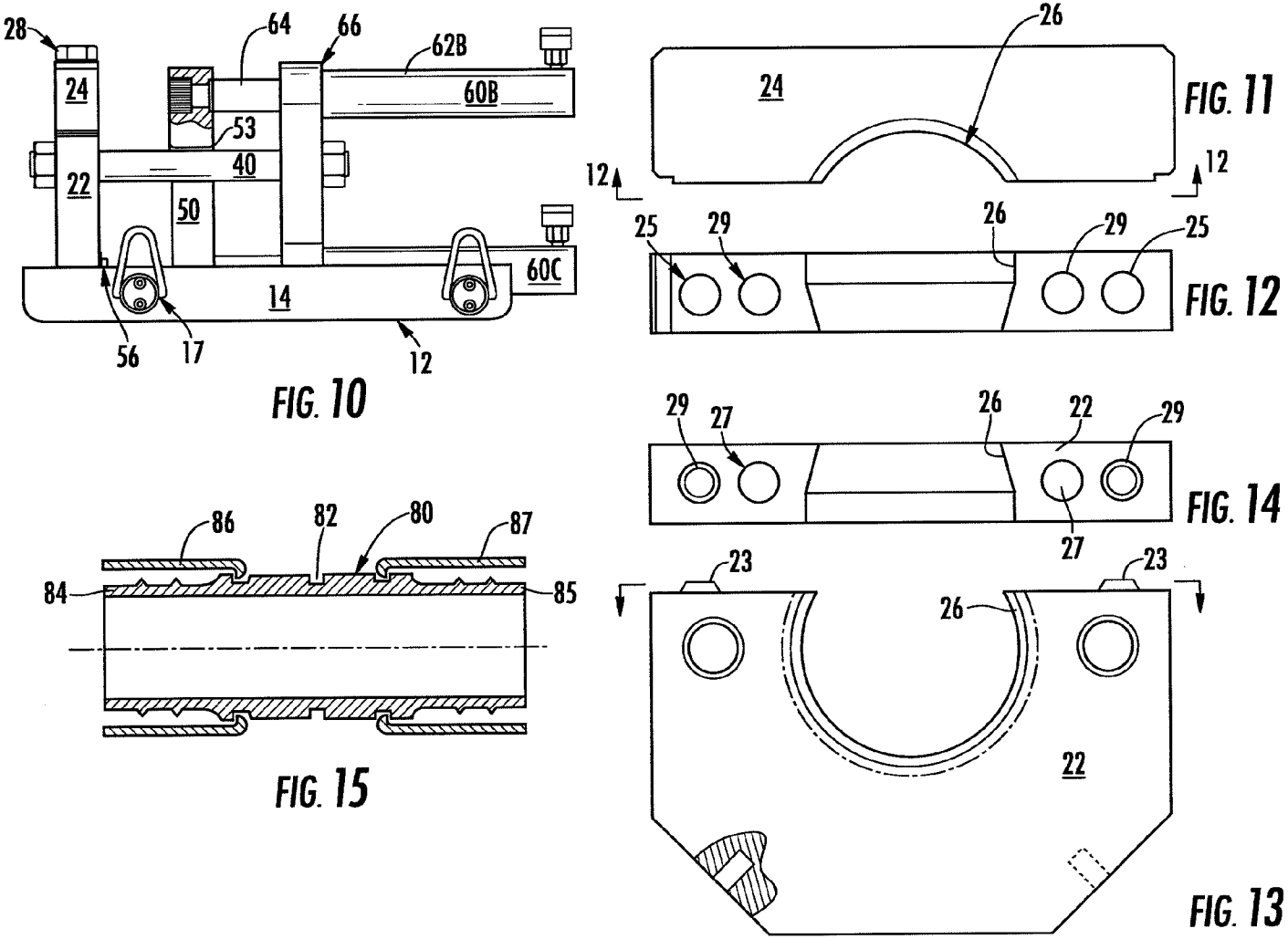
FIG. 10 is a side elevational view of the tube splicing machine in a position advancing from the loading position toward the swaging position.
FIG. 11 is a detail view of the top plate portion of the die holder.
FIG. 12 is a view taken along lines 12-12 in FIG. 11.
FIG. 13 is a detailed view of the main plate portion of the die holder.
FIG. 14 is a view taken along line 14-14 in FIG. 13.
FIG. 15 is a cross-sectional view through a splice fitting of the type used in the tube splicing machine according to the invention.

As best shown in FIGS. 5 and 7-9, openings are provided in the main plate 22 adjacent to the die holding opening 26 for a holding screw 56. These openings are located on a splice fitting engagement plate side of the main plate 22 which, as shown in FIGS. 13 and 14, is the side with the greater portion of the tapered opening 26. A holding screw 56 is installed in the opening and includes an enlarged head or washer 58 that overlaps a portion of the die holding opening 26 when installed. The enlarged head or washer 58 overlaps the swaging die 30, as best shown in FIG. 9, holding the swaging die 30 in the tapered swaging die opening 26 of the die holder 20.

Referring again to FIGS. 1-5, at least one guide rod and preferably two guide rods 40, 42 are connected to the die holder 20 and extend generally parallel to the runners 14, 16 which define the direction of longitudinal extent of the frame 12. In a preferred embodiment, the guide rods 40, 42 have threaded ends and are engaged with the die holder 20 and particularly, the main plate 22 of the die holder 20 via engagement of the threaded ends of the guide rods 40, 42 in openings in the main plate 22 and nuts being installed on the ends. Preferably, an actuator holding plate 66 is also attached to the guide rails 14, 16. The actuator holding plate 66 is described in further detail below. The guide rods 40, 42 are connected with their other ends to the actuator holding plate 66.

Figure 20:
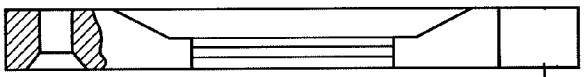
FIG. 20 is a top view, partially in cross-section taken along lines 20-20 in FIG. 19.
Figure 19:
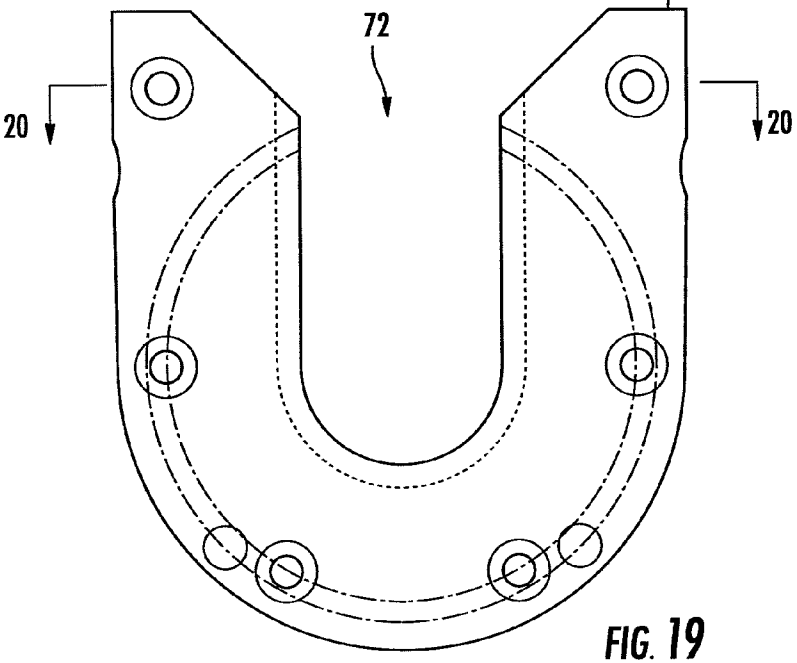
FIG. 19 is a detailed front view of the insert 70.

A splice fitting engagement plate 50 with a splice fitting engagement portion 52 is provided that is displaceable along the guide rods 40, 42. Preferably, the splice fitting engagement plate 50 includes recesses 53 arranged in complementary locations to the guide rods 40, 42 to allow for sliding movement. The splice fitting engagement plate 50 has an open or openable top 54 to allow removable connection to a splice fitting 80, described in detail below and shown in FIG. 15. In a preferred embodiment, the splice fitting engagement plate 50 is made from steel; however, other suitable materials can be utilized. Preferably, the splice fitting engagement portion 52 is formed via an insert 70 that is connected to the splice fitting engagement plate 50. The preferred insert 70, shown in detail in FIGS. 19 and 20, has a U-shaped opening 72 and is formed form hardened steel, such as 4340 steel with a Rockwell hardness >45C. Preferably, the insert 70 is located in a recess 55 formed in the splice fitting engagement plate 50 on a side of the splice fitting engagement plate 50 facing the die holder 20.

Referring to FIGS. 1-5 and 10, at least one actuator 60 and preferably actuators 60A, 60B and 60C are connected to the frame 12, via the actuator holding plate 66 and to the splice fitting engagement plate 50 for moving the splice fitting engagement plate 50 from a loading position, away from the die holder, as shown FIG. 1, to a swaging position, toward the die holder 20, in order to swage the splice fitting 80 onto a length of the hose or tubing 18, 19, as illustrated in FIGS. 6-9. The actuators 60A, 60B, 60C, include a housing 62A, 62B, 62C as well as a piston or ram 64 in order to move the splice fitting engagement plate 50 between the loading and swaging positions. FIG. 10 illustrates the splice fitting engagement plate 50 in the process of being moved toward the swaging position, with the piston or ram 64 extending out from the housing 62B of the actuator shown. As shown in FIG. 10, the piston or ram 64 is bolted to the splice fitting engagement plate 50. Preferably, the actuators 60A, 60B, 60C comprise air cylinders or hydraulic cylinders that are connected by the actuator holding plate 66 to the frame 12. Connections are shown in FIG. 10 from the actuators to a source of compressed fluid or gas for actuating the cylinders. In the preferred embodiment, the actuators are 10 ton hydraulic cylinders having a 12 inch stroke. However, other sizes and capacities for the actuators 60A, 60B, 60C could be utilized. Additionally, while three actuators 60A, 60B, 60C are preferred, any number of actuators could be utilized.

Figure 21:
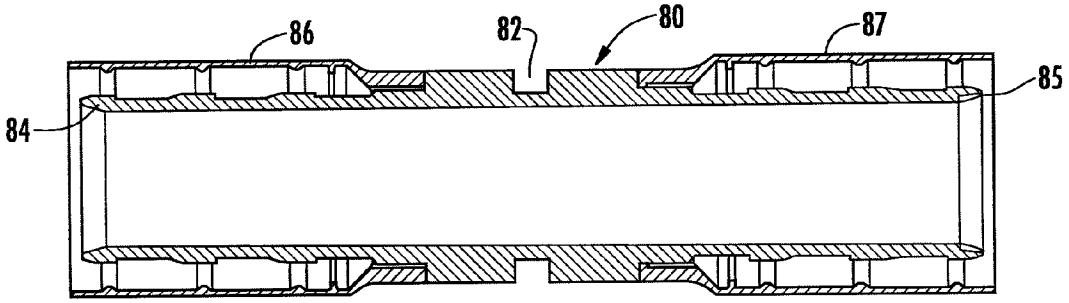
FIG. 21 is a cross-sectional view of a splice fitting.

Referring to FIG. 15, a splice fitting 80 is shown. The splice fitting 80 preferably includes insertion ends 84, 85, which may be barbed, and are adapted to be inserted inside the lengths of hose of tubing 18, 19 to be spliced. Swaging collars 86, 87 are also located on the splice fitting 80 and preferably include an inwardly directed portion which engages or is engagable in a corresponding groove in the fitting body. The engagement groove 82 is formed generally in a medial position of the splice fitting 80 which corresponds to a size of the U-shaped opening 72 of the insert 70 and, as shown in FIGS. 6-9, is adapted to be engaged by the splice fitting engagement portion 52 on the splice fitting engagement plate 50 that is formed by the insert 70. While a groove 82 and a corresponding U-shaped opening 72 in the insert 70 are preferred, other configurations for defining the engagement between the splice fitting engagement plate 50 and the splice fitting 80 could be provided. FIG. 21 shows a more detailed cross-sectional view of the splice fitting 82.

In use, the tube splicing machine 10 splices lengths of hose or tubing 18, 19, including quasi-endless lengths. In order to splice two lengths of hose or tubing 18, 19, the end of the first length of hose 18 is inserted through the swaging die 30 in the die holder 20 while the splice fitting engagement plate 50 being in the loading position. The first swaging collar 86 is positioned on the end on the first length of hose 18 and the first insertion portion 84 of the splice fitting 80 is inserted through the swaging collar and into the end of the first length of hose or tubing 18. This can be done simultaneously with the positioning of the swaging collar 86, if desired. The splice fitting 80 is then engaged with the splice fitting engagement portion 52 on the splice fitting engagement plate 50, namely by the U-shaped opening 72 of the insert 70 engaging in the groove 82 of the splice fitting 80. The one or more actuators 60A, 60B, 60C are then actuated to push the splice fitting engagement plate 50 with the splice fitting 80 and the first swaging collar 86 toward the swaging die 30 located in the die holder 20. The swaging collar 86 is forced into the die opening 36 of the swaging die 30 by the actuator 60A, 60B, 60C moving the splice fitting engagement plate 60 toward the die holder 20. This compresses the swaging collar 86 against the first length of hose 18 and the hose 18 against the first insertion portion 84 of the splice fitting 80 in order to form a permanent connection. Once completed, the actuators 60A, 60B, 60C can be moved back to the loading position. The bolts 28 are then removed in order to remove the top plate 24 and open the die holder 20. Based on the main plate 22 having a greater portion of the die holding opening 26 than the top plate 24, the die 30 remains held in position until the holding screws 56 are loosened or removed and the swaging die 30 can then be moved forward toward the splice fitting engagement plate and out of the die holding opening 26. The swaging die 30 can then be separated into the two die parts 32, 34 and the first length of hose 18 with the attached splice fitting 80 removed.

At this point, the tube splicing machine 10 is reassembled with the swaging die 30 being reinserted in the die holding opening 26. The holding screws 56 are reinstalled and the top plate 24 is bolted back into position. As the lengths of hose or tubing 18, 19 to be joined are quasi-endless, rather than attempting to move the hoses to a different position, the tube splicing machine 10 can be merely rotated 180° and the end of the second length of hose 19 is then inserted in the swaging die 30. As shown in FIGS. 7 and 8, the second swaging collar 87 is positioned on the end of the second length of hose 19 and the second insertion portion 85 of the splice fitting 80 is inserted into the end of the second length of hose or tubing 19 to be spliced. The splice fitting 80 is then engaged with the splice fitting engagement portion 52 of the splice fitting engagement plate 50, namely via the groove 82 in the splice fitting 80 being engaged in the U-shaped opening 72 of the insert 70. The actuator or actuators 60A, 60B, 60C are then actuated so that the splice fitting engagement plate 50 pushes the splice fitting 80 and the second swaging collar 87 into the swaging die 30, compressing the second swaging collar 87 against the end of the second length of hose or tubing 19 and the end of the second length of hose or tubing 19 against the second insertion portion 85 of the splice fitting 80 in order to form a permanent connection. The die holder 20 and swaging die 30 are then opened in the same manner as discussed above, and the second hose 19 with the attached splice fitting 80 is removed providing a permanent connection between the first and second lengths of hose 18, 19.

During the swaging process, depending upon the lengths of hose or tubing 18, 19 and their position, it is not necessary that the hose move relative to the splicing machine 10 as the splicing machine 10 can slide on the runners 14, 16 when the actuators 60A, 60B, 60C are actuated.

Referring to FIGS. 24-31, a second embodiment of a tube splicing machine 110 is shown. The tube splicing machine 110 is similar to the tube splicing machine 10 and similar elements have been identified with similar reference numbers that have been increased by 100. The tube splicing machine 110 includes a frame 112 having frame members 114 and 116. Lift lugs 117 may be attached to the frame members 114, 116 for ease in moving the tube splicing machine 110.

As in the first embodiment, a die holder 120 is located on the tube splicing machine 110. The die holder 120 includes a main plate 122 and a top plate 124 that is removably connected to the main plate 122 using fasteners 128. The main plate 122 is also connected to the actuator rods 164A, 164B of actuators 160A, 160B. Upon actuation, the actuators 160A, 160B can move the die holder 120 relative to the frame 112.

Figure 24:
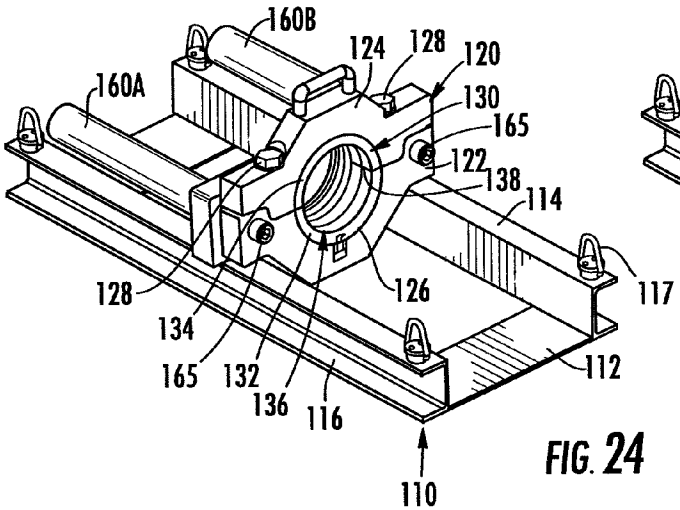
FIG. 24 is a perspective view of a second embodiment of a tube splicing machine in accordance with the present invention.
Figure 25:
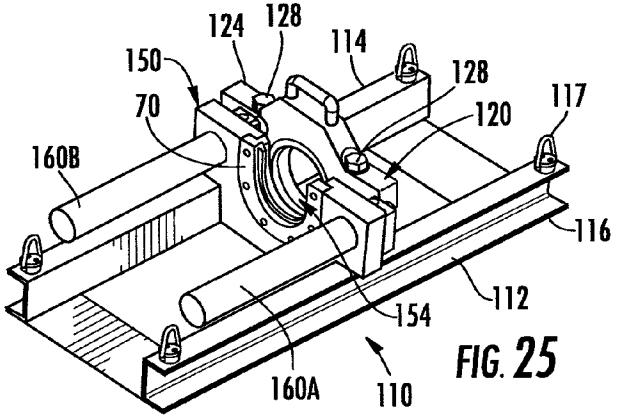
FIG. 25 is a perspective view of the tube splicing machine of FIG. 24 taken from the opposite side.
Figure 30:
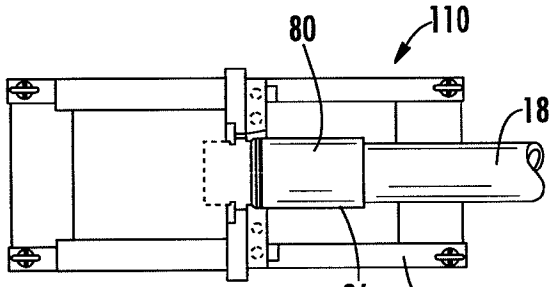
FIG. 30 is a top view of FIG. 28.
Figure 31:
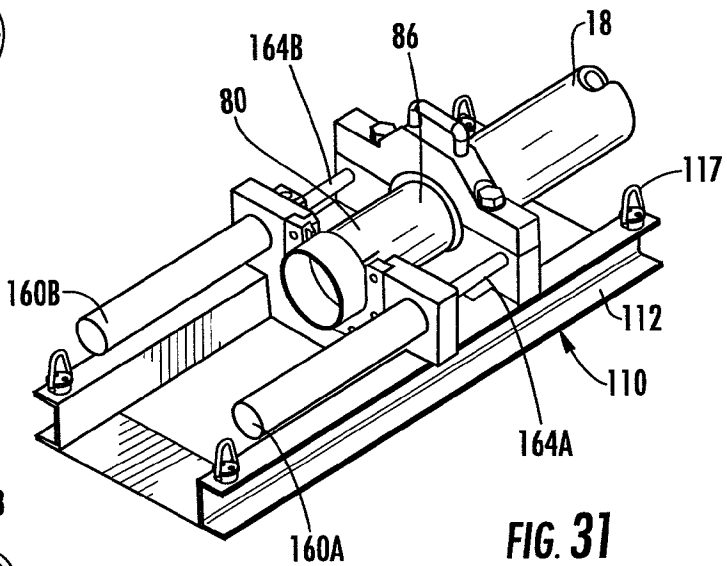
FIG. 31 is a perspective view showing the tube splicing machine after swaging the splice fitting onto one end of a tube, prior to removal of the die holder top plate for removing the tube and fitting from the machine.
Figure 28:
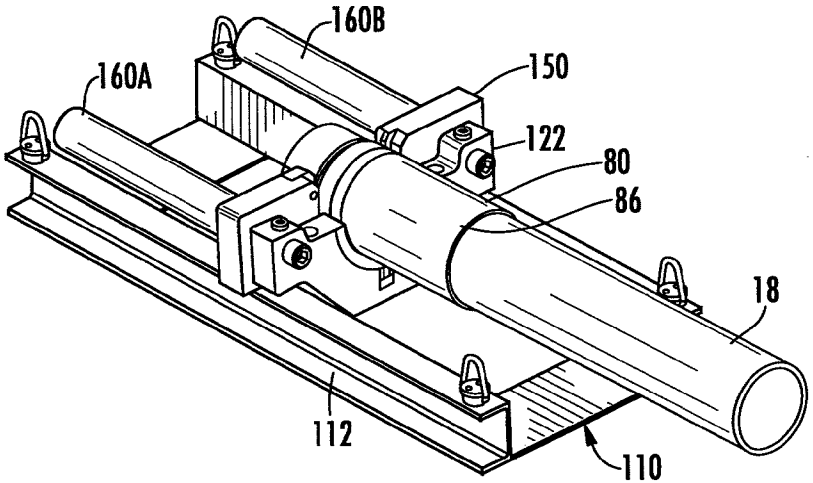
FIG. 28 is a view similar to FIG. 24 of the tube splicing machine with the splice fitting and tube shown in position for swaging.
Figure 29:
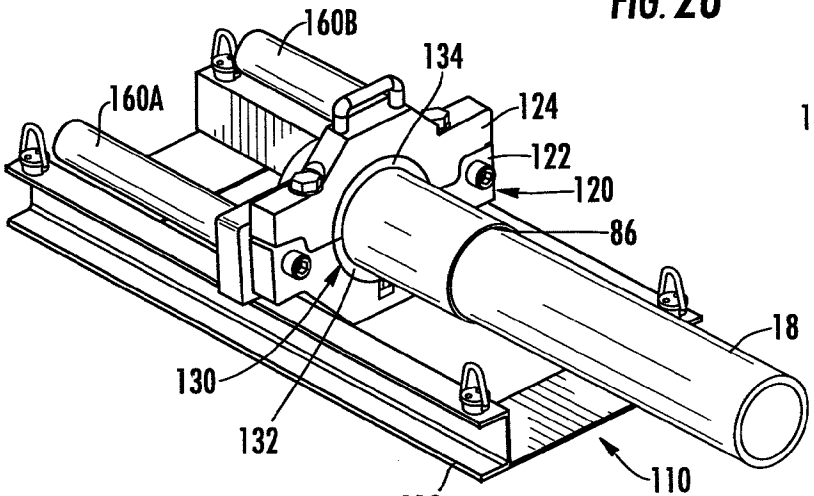
FIG. 29 is a view similar to FIG. 28 of the tube splicing machine with the die holder top plate installed over the splice fitting.

A splice fitting engagement plate 150 with a splice fitting engagement portion 152 is mounted to the frame rails 114, 116 of the frame 112 in a fixed position. The splice fitting engagement plate 150 has an open or openable top 154 to allow removable connection to a splice fitting 80, as described in detail above. Preferably, the splice fitting engagement portion 152 is formed via the insert 70 as described above. In the second preferred embodiment, the actuators 160A, 160B are mounted to the splice fitting engagement plate 150 which includes holes that extend there through such that the actuator rods 164A, 164B of the actuators 160A, 160B can be connected to the main plate 122 of the die holder 120, preferably by fasteners 165 as shown in FIGS. 24 and 25.

A swaging die 130 which is generally constructed the same as the swaging die 30 noted above, is located in the die holding opening 126 that is defined through the main plate 122 and the top plate 124. Swaging die 130 includes two die parts 132, 134 that together define a die opening 136. These die parts 132, 134 are separable along a midline 138 of the die opening 136.

In operation, the tube splicing machine 110 is used in the same manner as the tube splicing machine 10 noted above in that a first length of hose or tube 18 is inserted into the first insertion portion of a splice fitting 80, with the splice fitting 80 being inserted through the swaging collar into the end of the first length of tubing or hose. The splice fitting 80 is then engaged with the splice fitting engagement portion 152 on the splice fitting engagement plate 150 namely by the U-shaped opening 72 of the insert 70 engaging in the groove 82 of the splice fitting 80. The actuators 160A, 160B are then actuated to push the die holder 120 with the swaging die 130 located therein over the swaging collar 86 in order to crimp it onto the first hose or tube 18. This can be seen in FIGS. 29 and 31 which show the die holder 120 in the first position prior to actuation of the actuators 160A, 160B, and in the second position with the swaging collar 86 swaged into position on the end of the hose or tube 18.

One potential advantage of the second embodiment of the tube splicing machine 110 is that during swaging, the machine 110 is not required to slide along the ground and the hose 18 is also maintained in a fixed position.

Once the first end of the splice fitting 80 has been swaged onto the first length of hose 18, the top plate 124 along with the upper die part 134 of the swaging die are removed so that the tube splicing machine 110 can be repositioned in order to splice a second length of hose or tubing 19 into the second swaging collar 87 on the second insertion end 85 of the splice fitting 80. The swaging operation is carried out in the same manner noted above.

The tube splicing machine 10, 110 allows for simple permanent splicing of quasi-endless lengths of tubing or hose 18, 19 in a simple manner in the field and without the need for welding. Based on the arrangement, there is also no need to have access to the opposite end of quasi-endless lengths of hose or tubing 18, 19 in order to remove the installation equipment. Additionally, it is possible to splice tubing or hoses of different sizes using an appropriately sized splice fitting and using different swaging dies in the swaging die opening 26 that are sized for the specific hose sizes being joined.

Figure 22:
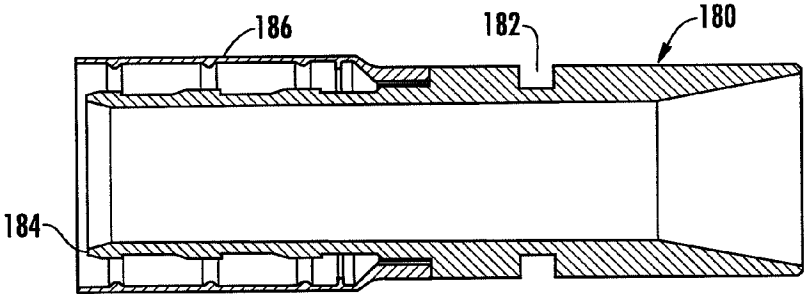
FIG. 22 is a cross-sectional view through a stub fitting.
Figure 23:
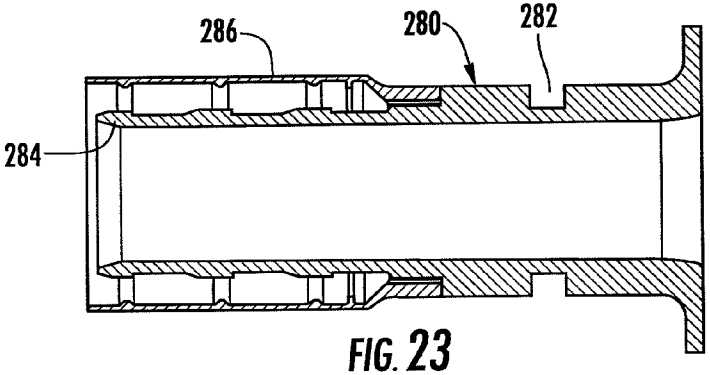
FIG. 23 is a cross-sectional view through a flanged fitting.
Figure 26:
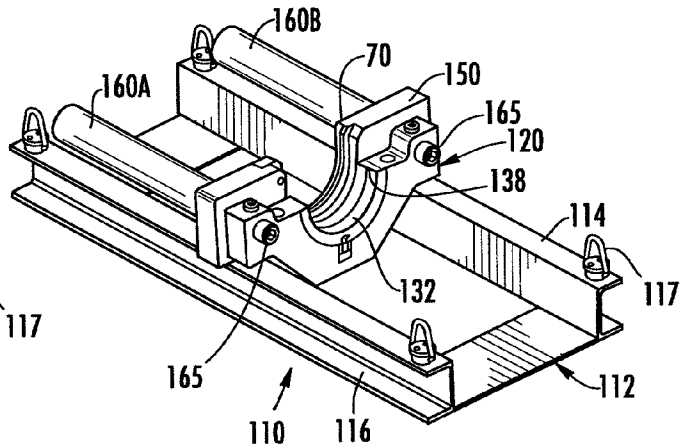
FIG. 26 is a view similar to FIG. 24 of the tube splicing machine with the die holder top plate removed.
Figure 27:
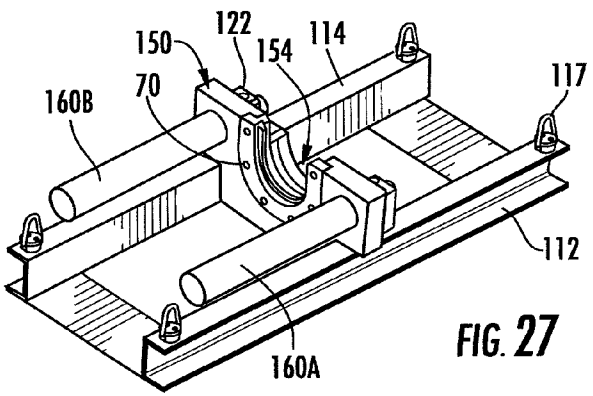
FIG. 27 is a view similar to FIG. 25 of the tube splicing machine with the die holder top plate removed.

The splicing machines 10, 110 are capable of installing various other types of non-splice couplings, such as threaded, flanged, or weld stub couplings. Referring to FIGS. 22 and 23, two of these other types of terminal fittings that can be attached to the ends of a hose or tube using the splicing machine 10 are shown. In FIG. 22, an end fitting 180 is provided that includes a groove 182, an insertion end 184 and a swaging collar 186. The opposite end can be connected to other pipes or vessels by various means, such as welding. In FIG. 23, an end fitting 282 is shown having a similar groove 282, insertion end 284 and swaging collar 286. The opposite end of the fitting includes a flange for connection to various other pipes, valves or vessels.

Additionally, since one end of the splicing machine 10, 110 is open, it can also attach custom termination fittings that can be assembled in a shop and then installed in the field. An example of this is a steel riser assembly that brings the pipe above ground. Riser assemblies can include welded elbows, steel pipe and valves. The assembly can be welded in the shop and then brought to the field in one piece and attached to the end of the tubing, with the open ended portion of the splicing machine allowing for easy access for installation, and the removability of the top plate 24, 124 and die parts 32, 34; 132, 134 allowing easy removal of the machine 10, 110 after riser installation.

Those skilled in the art will appreciate that various other modifications can be made to the tube splicing machine 10, 110 described above which would still fall within the scope of the present invention which is defined by the appended claims.

What is claimed is:

1. A tube splicing machine, comprising:

a frame;

a die holder located on the frame, with a swaging die removably mounted in the die holder, the die holder including a main plate and a top plate removably connected to the main plate, with a die holding opening defined through a portion of the main plate and the top plate, the swaging die including two die parts that together define a die opening and are separable along a mid-line of the die opening;

a splice fitting engagement plate with a splice fitting engagement portion that is located on the frame, the splice fitting engagement plate having an open or openable top to allow removable connection to a splice fitting; and an actuator connected to the splice fitting engagement plate and the frame that moves the splice fitting engagement plate relative to the die holder in an axial direction of the splice fitting from an initial position in which the splice fitting is located outside of the swaging die, to a swaged position in which the splice fitting is forced axially through the swaging die in order to swage the splice fitting onto a length of hose or tubing.

2. The tube splicing machine according to claim 1, wherein the frame comprises two runners.

3. The tube splicing machine according to claim 1, wherein the top plate and the main plate are openable for removal of a hose or tube after attachment of a splice fitting.

4. The tube splicing machine according to claim 1, wherein the top plate is connected to the main plate via two bolts.

5. The tube splicing machine according to claim 1, wherein the die opening is tapered for swaging a collar onto a hose or tube.

6. The tube splicing machine according to claim 1, wherein the two die parts are formed of a hardened steel.

7. The tube splicing machine according to claim 1, wherein the die holding opening is tapered or stepped, and has a reduced open area on a side of the die holder facing away from the splice fitting engagement plate, and an outside surface of the swaging die has a complementary profile to the die holding opening.

8. The tube splicing machine according to claim 1, wherein the main plate includes at least one opening for a holding screw adjacent to the die holding opening on a splice fitting engagement plate side of the main plate, and a holding screw with an enlarged head is inserted in the at least one opening and the enlarged head overlaps the swaging die.

9. The tube splicing machine according to claim 1, wherein the actuators comprise air cylinders or hydraulic cylinders that are connected to the frame.

10. The tube splicing machine according to claim 1, wherein the splice fitting engagement portion comprises an insert connected to the splice fitting engagement plate having a U-shaped opening.

11. Method for splicing lengths of hose or tubing, comprising:

providing a tube splicing machine having a frame, a die holder located on the frame, with a swaging die removably mounted in the die holder, the die holder including a main plate and a top plate removably connected to the main plate, with a die holding opening defined through a portion of the main plate and the top plate, the swaging die including two die parts that together define a die opening and are separable along a mid-line of the die opening, a splice fitting engagement plate with a splice fitting engagement portion that is located on the frame, the splice fitting engagement plate having an open or openable top to allow removable connection to a splice fitting, and an actuator connected between the splice fitting engagement plate and the frame for moving the splice fitting engagement plate relative to the die holder in an axial direction of the splice fitting from an initial position to a swaging position in order to swage a splice fitting onto a length of hose or tubing;

providing first and second lengths of hose or tubing to be spliced and a splice fitting having first and second insertion portions facing in opposite directions and first and second swaging collars;

locating an end of the first length of hose or tubing in the swaging die;

positioning the first swaging collar on the end of first length of hose or tubing and inserting the first insertion portion through the first swaging collar and into the first hose or tubing end;

engaging the splice fitting with the splice fitting engagement portion on the splice fitting engagement plate;

actuating the actuator so that the splice fitting engagement plate moves relative to the die holder in an axial direction of the splice fitting to push the splice fitting and the first swaging collar into swaging die, compressing the swaging collar against the first length of hose or tubing and the hose or tubing against the first insertion portion to form a permanent connection;

opening the die holder and the swaging die and removing first length of hose or tubing with the attached splice fitting;

locating an end of the second length of hose or tubing in the swaging die;

positioning the second swaging collar on the end of the second length of hose or tubing and inserting the second insertion portion through the second swaging collar and into the end of the second length of hose or tubing to be spliced;

engaging the splice fitting with the splice fitting engagement portion on the splice fitting engagement plate;

actuating the actuator so that the splice fitting engagement plate moves relative to the die holder in an axial direction of the splice fitting to push the splice fitting and the second swaging collar into the swaging die, compressing the second swaging collar against the end of the second length of hose or tubing and the second length of hose or tubing against the second insertion portion to form a permanent connection; and opening the die holder and the swaging die and removing the second length of hose or tubing with the attached splice fitting so that a permanent connection is made between the first and second lengths of hose or tubing.

* * * * *